United States Patent [19]
Longanbach et al.
[11] 4,188,191
[45] Feb. 12, 1980

[54] PROCESS FOR REDUCING THE SULFUR CONTENT OF COAL AND COAL CHAR AND THE IGNITION TEMPERATURE OF COAL CHAR

[75] Inventors: James R. Longanbach, Claremont; Leon Robinson, Upland, both of Calif.

[73] Assignee: Occidental Petroleum Corporation, Los Angeles, Calif.

[21] Appl. No.: 629,875

[22] Filed: Nov. 7, 1975

Related U.S. Application Data

[63] Continuation of Ser. No. 429,708, Jan. 2, 1974, abandoned.

[51] Int. Cl.[2] ..... C10L 9/10; C10B 57/00
[52] U.S. Cl. ..... 44/1 F; 44/1 SR; 201/17
[58] Field of Search ..... 44/1 R, 1 F; 201/17

[56] References Cited

U.S. PATENT DOCUMENTS 2,878,163 3/1959 Hutchings ..... 201/17 X

OTHER PUBLICATIONS

"The Effect of Molten Caustic on Pyritic Sulfur in Bituminous Coal" by P. X. Masciantonio from "Fuel", vol. 44, pp. 269–275–London.

*Primary Examiner*—Carl F. Dees
*Attorney, Agent, or Firm*—Forrest E. Logan

[57] ABSTRACT

This invention covers a process for reducing the sulfur content of coal and coal char and the ignition temperature of coal char. Coal is converted into char at temperatures not in excess of about 1600° F. The char is introduced into a caustic system which is maintained at a temperature between about 500° F. to about 750° F. Intimate contact is maintained between the caustic and the char for a period of about 2 to 30 minutes to leach the sulfur from the char. The desulfurized char is thereafter separated from the caustic and washed.

1 Claim, No Drawings

PROCESS FOR REDUCING THE SULFUR CONTENT OF COAL AND COAL CHAR AND THE IGNITION TEMPERATURE OF COAL CHAR

This application is a continuation of Ser. No. 429,708 filed Jan. 2, 1974 now abandoned.

BACKGROUND OF THE INVENTION

Commercial desulfurization techniques only remove a portion of the sulfur present in coal or in coal chars. This is inadequate for purposes of complying with air purity standards which limit the amount of sulfur dioxide produced by the use of coals, chars, and other carbonaceous materials as a fuel. The need for a relatively sulfur-free char has therefore become very important, especially in view of dwindling supplies of oil and natural gas and abundant supplies of coal.

One method of desulfurizing coal is by first crushing and grinding the coal and introducing the coal fines into a fluid medium to allow the sulfur in the form of $FeS_2$ (pyrite) to form a separate layer which is mechanically removed from the coal. This technique, however, does not remove the $FeS_2$ embedded in the uncrushed coal and does not remove any of the sulfur bound to organic compounds.

Another method is to treat coal and char with hydrogen gas which leaches out the sulfur by reacting therewith to form hydrogen sulfide gas. This method may work with coal but not with char because when coal is converted into char, chemical reactions occur between the sulfur and the inorganic and organic compounds in the coal which "fixes" the sulfur in the char and renders the sulfur more resistant to leaching operations.

Hot, molten caustic has also been used to leach sulfur from finely divided coal. This approach, however, removes only a partial amount of the sulfur and would not appear to be suitable for desulfurizing char due to the "fixing" of the sulfur when coal is converted to char. Furthermore, sulfur bound with organic compounds is leached out in the molten caustic method only after the coal is in a semi-fluid or plastic condition. Char does not become semi-fluid or plastic and would therefore not appear to be usable in a molten caustic system.

SUMMARY OF THE INVENTION

It has been discovered that greatly improved results in desulfurizing coal and char are achieved if the coal is first converted into char by heating at temperatures which do not exceed about 1600° F., and thereafter treating the char in a hot caustic system. It is surprising and unexpected that char is desulfurized in a hot caustic system in view of the fact that char does not attain the fluid condition believed to be necessary during the desulfurization of coal with a hot caustic system.

It has further been discovered that the method of the instant invention substantially reduces the ignition temperatures of char produced thereby. This is desirable inasmuch as less heat or energy is required to effect ignition of such chars. An object of the invention is to lower the sulfur content of char.

A further object is to lower the sulfur content of char to about 0.7 percent by weight or less on a dry basis.

EMBODIMENT OF THE INVENTION

In practicing the method of the instant invention, coal is converted into char by conventional methods provided the charring temperatures do not exceed about 1600° F. Chars produced at temperatures between about 1000° F. and 1600° F. are capable of having between about 50% to about 99% of their sulfur removed, with the optimum desulfurization occurring when the coal has been charred at temperatures of about 1000° F. to 1100° F. The 1600° F. figure represents the upper temperature limit contemplated by the instant invention. Coals that are charred at temperatures above 1600° F. can be desulfurized to an extent but the degree of desulfurization will not be as great as when the charring temperatures are maintained below 1600° F.

The char, following its preparation as aforesaid, is introduced into a caustic system, such as for example, a bath of hot molten caustic. The char need not be specially treated or prepared but is admixed into the molten caustic bath in the condition that it exists after it is manufactured. The materials used to form the caustic bath may be any caustic substances, such as for example, sodium hydroxide, potassium hydroxide, calcium oxide, sodium carbonate, or any other caustic material or combination thereof.

The aforesaid caustic materials which are solids at ambient temperatures are heated to a temperature above their melting point to form and maintain the caustic as a liquid. In the preferred embodiment, the caustic bath comprises one part of sodium hydroxide to one part of potassium hydroxide and is heated and maintained at a temperature between about 500° F. to about 750° F.

The ratio of caustic to char should be maintained at a level which will effect maximum desulfurization. In the preferred embodiment, this ratio is at least three parts of a 50/50 NaOH-KOH mixture to one part of char.

When the char is introduced into the bath, it is admixed therein by means of a motor-driven stirrer or other equivalent means which will provide a thorough mixing of the char with the molten caustic for intimate contact therebetween. An inert medium, such as nitrogen gas, may be admixed into the charcaustic mixture to eliminate the presence of oxygen therein and prevent the possibility of any reactions therewith. The elimination of oxygen from the bath, however, is not necessary to the practice of the instant invention.

The period of intimate contact between the char and caustic of aforesaid is referred to as the residence time and should be about two to about forty minutes. About thirty minutes is preferred for maximum desulfurization. After the prescribed residence time, the char is allowed to rise to the surface of the bath where it is decanted or skimmed off by conventional flotation separation means. The char is thereafter washed with water to remove the caustic materials until the pH of the water is not changed after washing the char.

Chars desulfurized by the method of the instant invention have been found to have lower ignition temperatures than chars which have not been desulfurized. The lowering of the ignition temperature of char or coal by the addition of an alkali metal thereto is known, but the chars produced by the instant invention do not have alkali metals added thereto and would not be expected to have lower ignition temperatures. This is a surprising finding and a significant advantage in the use of such chars inasmuch as the presence of alkali metals in the char is detrimental to furnaces in which the chars are used as fuels.

EXAMPLE I

To demonstrate the effect of charring temperatures upon desulfurization of char, seven specimens of char, each weighing 25 grams and having a −60 mesh particle size, were prepared from Hamilton coal at temperatures ranging from 1000° F. to 1800° F. Hamilton coal is obtained from Western Kentucky and is characterized by being bituminous and highly volatile. Molten baths of caustic corresponding for use with each said specimen were prepared in stainless steel beakers. The composition of each caustic bath was 100 grams of sodium hydroxide and 100 grams of potassium hydroxide which were melted on a hot plate which was set to provide a bath temperature of 400° C. (750° F.). A bimetallic thermometer was used to determine the temperature of the liquid caustic melts. Nitrogen gas was fed into each hot caustic melt to remove any oxygen present therein. Each char specimen was admixed into each caustic bath and the caustic-char mixtures were stirred for thirty minutes at a temperature of 400° C. The reactions were stopped by the addition of water to each mixture which formed an aqueous solution with the molten caustic. The desulfurized char remaining in the aqueous solution was removed by filtration and washed with water until no further change in the pH of the wash water was noted. Each char specimen was air-dried and analyzed for its sulfur content and compared against the sulfur content of each char specimen before treatment by the caustic bath. The results were as follows:

| Charring Temperature of the Specimen | Percent of Total Sulfur Content of the Char Before Treatment with the Caustic Melt | Percent of Total Sulfur Content of the Char After Treatment by the Hot Caustic Melt | Percentage of Sulfur Removal |
|---|---|---|---|
| 1000° F. | 1.88 | 0.09* | 95.2 |
| 1000° F. | 1.81 | 0.01 | 99.5 |
| 1200° F. | 1.88 | 0.11 | 94.2 |
| 1400° F. | 1.79 | 0.25 | 86.0 |
| 1600° F. | 1.73 | 0.85 | 50.9 |
| 1600° F. | 1.82 | 0.76 | 58.2 |
| 1800° F. | 1.75 | 1.08 | 38.4 |

*For this particular specimen, the caustic bath consisted of 50 grams of sodium hydroxide and 50 grams of potassium hydroxide, rather than 100 grams of potassium hydroxide and 100 grams of sodium hydroxide which were used for all the other specimens.

EXAMPLE II

To demonstrate the effect of residence time upon desulfurization, six 25-gram specimens of char were manufactured and desulfurized as described in Example I hereinabove, except that the char was manufactured at a temperature of 1000° F. and the residence time was varied from two minutes to thirty minutes. The results expressed in terms of weight percents of the total weights are as follows:

| Residence Time | Water Content | Ash Content | Total Sulfur Content | Pyrite Content ($FeS_2$) | Other Inorganic Sulfur | Sulfur Containing Organic Compounds |
|---|---|---|---|---|---|---|
| 0 min. | 1.49 | 32.91 | 2.85 | .63 | .13 | 1.40 |
| 2 min. | 12.10 | 14.56 | 0.73 | 0.12 | 0.02 | 0.59 |
| 5 min. | 12.55 | 13.18 | 0.46 | 0.12 | 0.07 | 0.27 |
| 10 min. | 29.77 | 12.87 | 0.07 | 0.05 | 0.00 | 0.02 |
| 20 min. | 10.69 | 16.47 | 0.15 | 0.10 | 0.00 | 0.05 |
| 30 min. | 15.93 | 19.92 | 0.06 | 0.08 | 0.00 | — |

The results of Example II recalculated on a dry basis, i.e., by not including the water content, are as follows:

| Residence Time | Ash Content | Total Sulfur Content | Pyrite Content ($FeS_2$) | Other Inorganic Sulfur | Sulfur Containing Organic Compounds | Percentage of Sulfur Removal |
|---|---|---|---|---|---|---|
| 0 | 33.41 | 2.89 | 0.64 | 0.13 | 1.42 | — |
| 2 | 16.56 | 0.83 | 0.14 | 0.02 | 0.67 | 71.3 |
| 5 | 15.07 | 0.53 | 0.14 | 0.08 | 0.31 | 81.7 |
| 10 | 18.33 | 0.10 | 0.07 | 0 | 0.03 | 96.5 |
| 20 | 18.44 | 0.17 | 0.11 | 0 | 0.06 | 94.1 |
| 30 | 23.69 | 0.07 | 0.10 | 0 | — | 97.6 |

EXAMPLE III

To demonstrate the effect of desulfurization on the ignition temperature of char, a char was prepared from Hamilton coal at a temperature of 1400° F. A 25-gram portion of this char having a −60 mesh particle size was desulfurized by the procedure set forth in Example I hereinabove and compared against a 25-gram portion of the char that was not desulfurized and a 25-gram specimen of the parent coal specimen. The results were as follows:

| Specimen | Ignition Temperature | Percent Ash Content | Percent Total Sulfur Content | Percentage of Sodium in Ash | Percent of Potassium in Ash |
|---|---|---|---|---|---|
| Coal | 1060° F. | 7.92 | 2.75 | 0.64 | 2.32 |
| Char | 1260° F. | 10.79 | 1.75 | 1.45 | 2.32 |
| Desulfurized Char | 1060° F. | 5.74 | 0.25 | 1.50 | 1.72 |

About 91% of the sulfur was removed from the coal, and about 86% of the sulfur was removed from the char.

EXAMPLE IV

To further demonstrate the efficiency of the instant invention, a coal char was prepared from Hamilton coal at 1000° F. and divided into two 25-gram specimens having a −60 mesh particle size. The aforesaid specimens were desulfurized by the procedure set forth in Example I hereinabove, and were analyzed and compared against the analysis of the two specimens which were not desulfurized after their conversion into char as aforesaid. The results were as follows:

| Water Content | Percent Ash Content | Percent Total Sulfur | Pyrite Sulfur | Sulfide Sulfur | Organic Sulfur |
|---|---|---|---|---|---|
| Analysis of Char Before the Caustic Bath Treatment | | | | | |
| 1.02 | 9.56 | 1.79 | 0.24 | 0.41 | 1.14 |
| | | Dry Basis | | | |
| — | 9.66 | 1.81 | 0.24 | 0.41 | 1.16 |
| Analysis of Char After the Hot Caustic Bath | | | | | |
| 13.25 | 2.99 | 0.01 | 0.01 | 0.00 | 0.00 |
| | | Dry Basis | | | |
| — | 3.45 | 0.01 | 0.01 | 0.00 | 0.00 |

The percentage of desulfurization for the specimen of Example IV was about 99.4.

While the embodiment of the invention chosen herein for purposes of the disclosure is at present considered to be preferred, it is to be understood that this invention is intended to cover all changes and modifications in the disclosed embodiments which fall within the spirit and scope of the invention.

What we claim as our invention is:

1. A process for producing low sulfur char from coal comprising converting said coal to char at a temperature of about 1000° F. to about 1100° F.; and adding said char to a bath of molten caustic, said bath having a ratio of molten caustic to char of at least about three to one, for a residence time of about ten minutes, wherein said molten caustic is formed from a mixture of about equal parts of sodium hydroxide and potassium hydroxide, said bath is maintained at a temperature of about 500° F. to about 750° F., said char is removed from said bath and washed sufficiently to cause said char to be substantially free of said caustic, and the sulfur content of said char is reduced to a value no greater than about 0.7 percent by weight on a dry basis.

* * * * *